United States Patent [19]

Slatter et al.

[11] Patent Number: 5,052,967

[45] Date of Patent: Oct. 1, 1991

[54] NOVELTY FLY SWATTING DEVICE

[76] Inventors: Gerry E. Slatter; Mary P. Slatter, both of 9053 Salem Rd., St. Cloud, Fla. 34773

[21] Appl. No.: 574,885

[22] Filed: Aug. 30, 1990

[51] Int. Cl.[5] ..... A63H 3/00; A63H 5/00; A01M 3/02; A63B 67/00

[52] U.S. Cl. ..... 446/73; 446/418; 446/1; 43/137; 273/446

[58] Field of Search ..... 446/1, 418, 192, 763; 43/137; 211/87, 89, 70.6; 248/316.8, 304; 273/1 G, 1 GC

[56] References Cited

U.S. PATENT DOCUMENTS

| | | | |
|---|---|---|---|
| 1,555,993 | 10/1925 | Larson | 446/1 |
| 3,031,794 | 5/1962 | Zalkind | 43/137 |
| 3,390,483 | 7/1968 | Doe | 446/1 |
| 3,841,629 | 10/1974 | Barlow | 273/1 GE |
| 3,927,880 | 12/1975 | Petrusek | 273/1 E |
| 3,996,690 | 12/1976 | Ridings | 43/137 |
| 4,681,233 | 7/1987 | Roth | 211/87 |

*Primary Examiner*—Danton D. DeMille
*Attorney, Agent, or Firm*—Leon Gilden

[57] ABSTRACT

A novelty device is presented as a therapeutic and entertaining organization to permit positioning of an actual or simulation of insect upon an anvil and utilizing a hammer member mounted upon a forward surface of a support base underlying the anvil to effect impact of the insect. A modification of the instant invention includes an audible device actuated upon impacting the anvil by the hammer assembly.

5 Claims, 3 Drawing Sheets

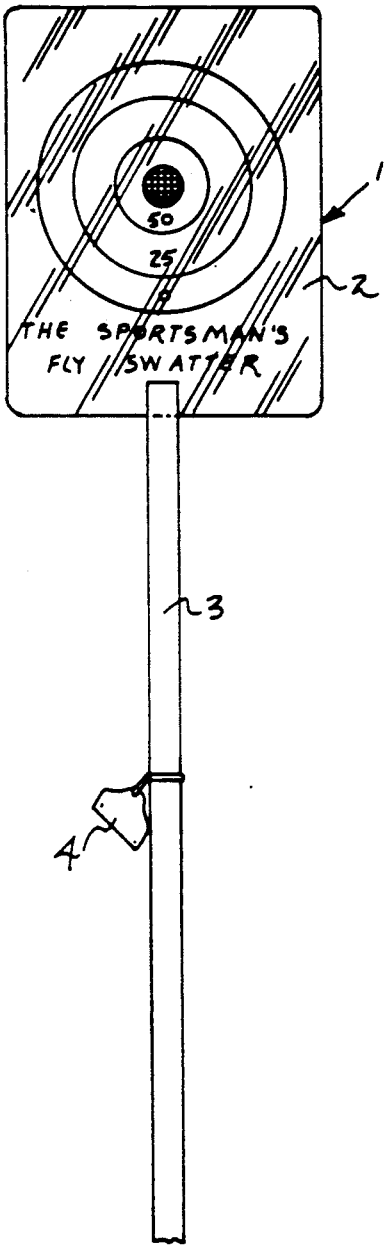
Fig 1
PRIOR ART
Fig 2
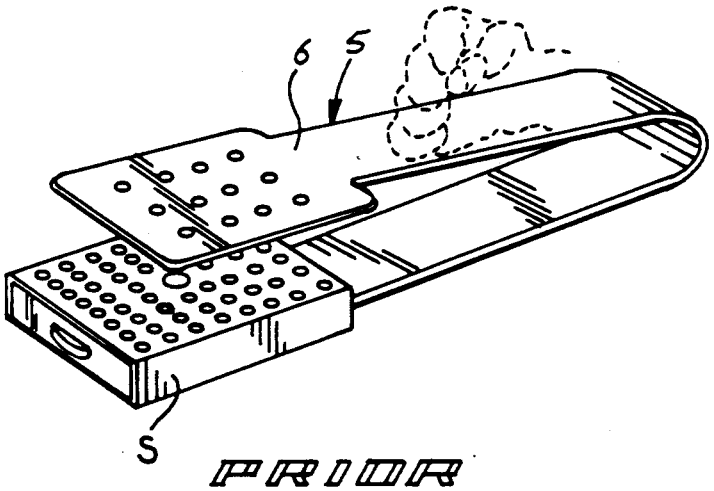
PRIOR ART

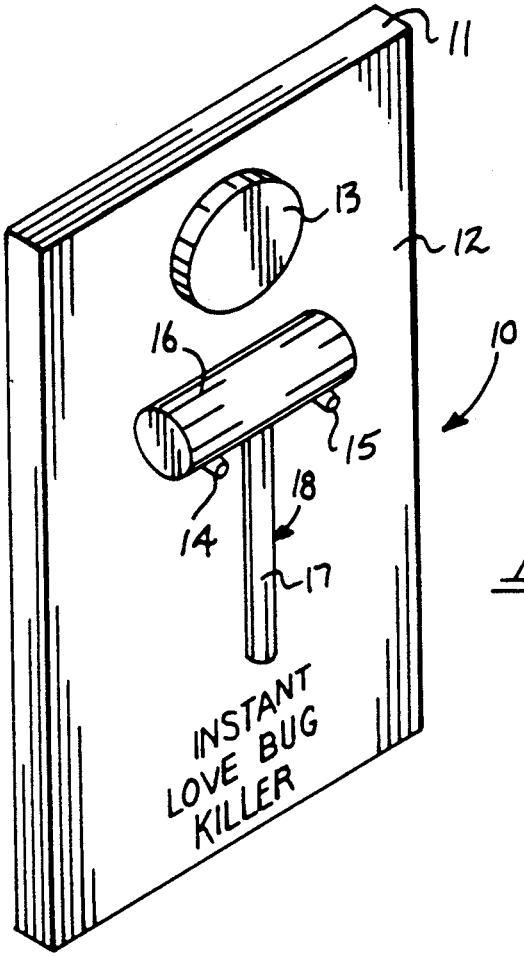
Fig 3
Fig 4
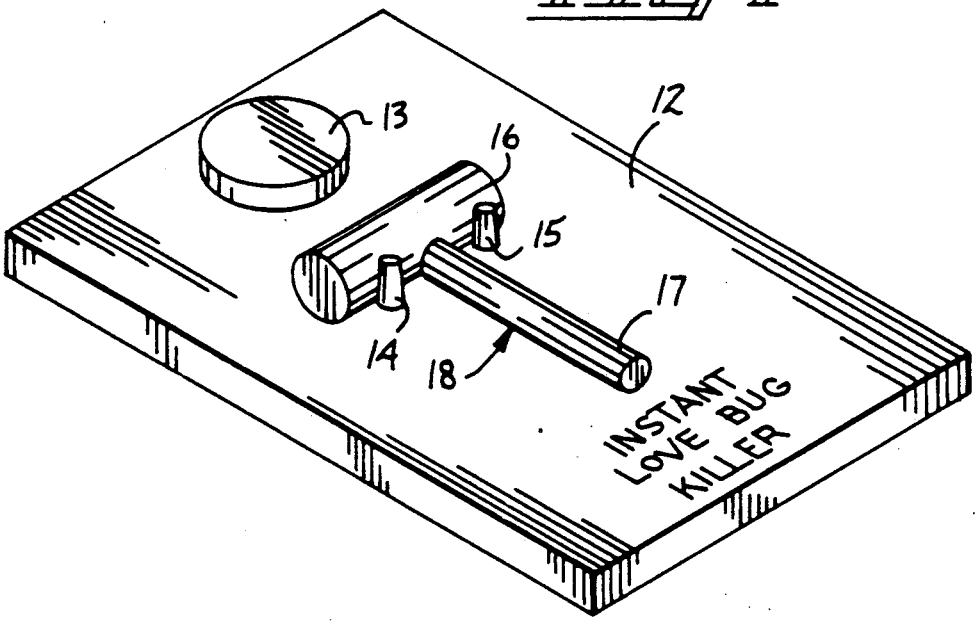

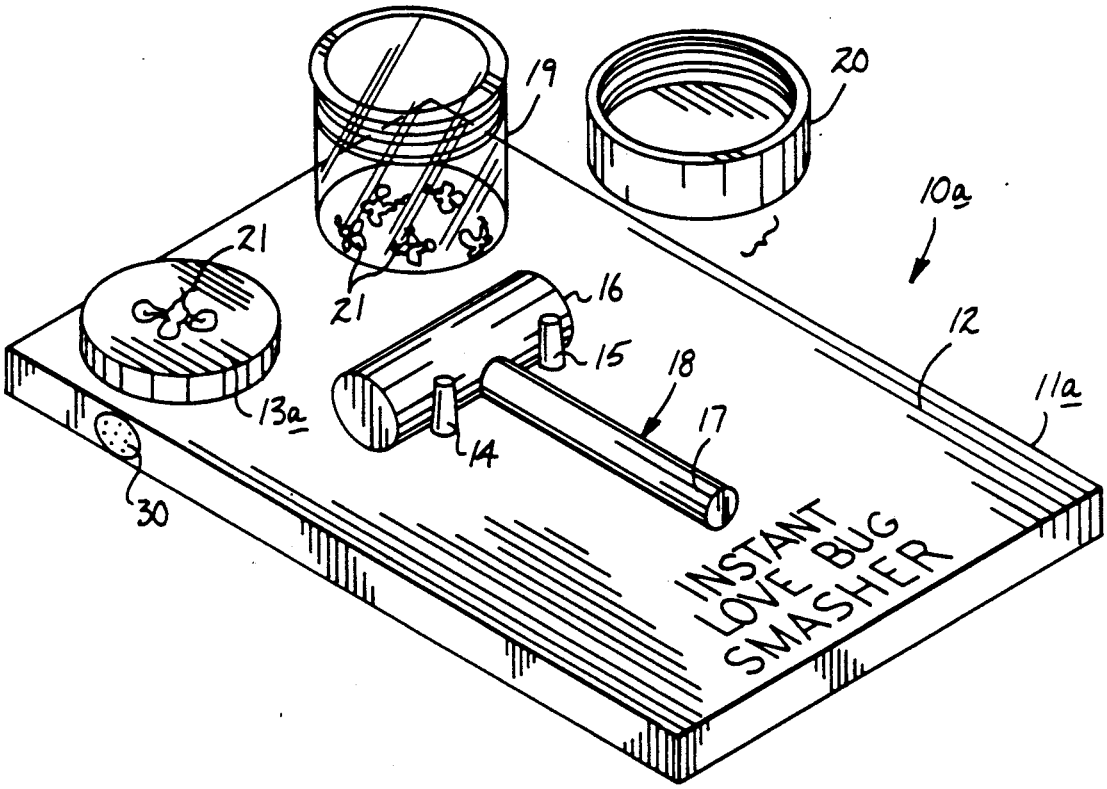
FIG 5
FIG 6
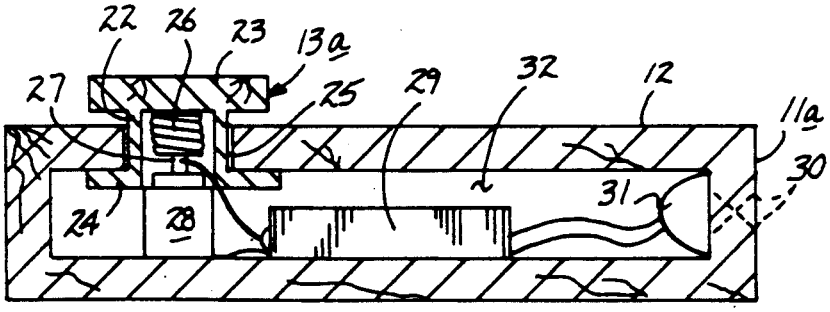

NOVELTY FLY SWATTING DEVICE

BACKGROUND OF THE INVENTION

1. Field of the Invention

The field of invention relates to novelty devices, and more particularly pertains to a new and improved novelty device to permit therapeutic and entertaining impacting of an actual or simultation insect.

2. Description of the Prior Art

Various novelty fly swatter and devices of the like have been provided in the prior art for impacting of insect type members, but the instant invention attempts to provide an organization permitting therapeutic and entertaining impact of an actual or simulation of insect for entertainment of an individual. Prior art devices arranged for impact of insect members may be found in U.S. Pat. No. 3,031,794 to Zalkind providing an insect fly swatter type device utilizing a bulls-eye type target imprinted upon the fly swatter organization.

U.S. Pat. No. 3,412,501 to Rosen sets forth a fly swatter utilizing an extensible handle.

U.S. Pat. No. 4,787,171 to Dagenais provides a fly swatter to prevent swilling of walls upon impact, wherein the fly swatter organization includes a cup-shaped body to adherably secure a flying insect therewithin upon impact of an associated insect member.

U.S. Pat. No. 4,651,464 to Baker provides a multi-surface fly swatter device comprising a relatively soft and rigid impacting surface selectively utilized by an individual.

U.S. Pat. No. 3,996,690 to Ridings provides a combination insect trap and fly swatter, wherein a receptacle is provided to attract an insect with a depressible overlying arm engageable to impact the insect.

As such, it may be appreciated that there continues to be a need for a new and improved novelty device as set forth by the instant invention which addresses both the problems of ease of use as well as effectiveness in construction in providing entertainment and amusement to individuals and in this respect, the present invention substantially fulfills this need.

SUMMARY OF THE INVENTION

In view of the foregoing disadvantages inherent in the known types of novelty insect impacting devices now present in the prior art, the present invention provides an novelty device wherein the same provides for a hammer and anvil arranged to position a simulation insect therebetween for entertainment and amusement. As such, the general purpose of the present invention, which will be described subsequently in greater detail, is to provide a new and improved novelty device which has all the advantages of the prior art insect impacting devices and none of the disadvantages.

To attain this, the present invention provides a novelty device presented as a therapeutic and entertaining organization to permit positioning of an actual or simulation of insect upon an anvil and utilizing a hammer member mounted upon a forward surface of a support base underlying the anvil to effect impact of the insect. A modification of the instant invention includes an audible device actuated upon impacting the anvil by the hammer assembly.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved novelty device which has all the advantages of the prior art insect impacting devices and none of the disadvantages.

It is another object of the present invention to provide a new and improved novelty device which may be easily and efficiently manufactured and marketed.

It is a further object of the present invention to provide a new and improved novelty device which is of a durable and reliable construction.

A even further object of the present invention is to provide a new and improved novelty device which is susceptible of a low cost of manufacture with regard to both materials and labor, and which accordingly is then susceptible of low prices of sale to the consuming public, thereby making such novelty devices economically available to the buying public.

Still yet another object of the present invention is to provide a new and improved novelty device which provides in the apparatuses and methods of the prior art some of the advantages thereof, while simultaneously overcoming some of the disadvantages normally associated therewith.

Still another object of the present invention is to provide a new and improved novelty device to provide entertainment and amusement upon impacting of a simulation insect incorporating an audible transmission device operative upon impact of the simulation insect.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic top view of a prior art fly swatter organization.

FIG. 2 is an isometric illustration of a further prior art flying insect impact device.

FIG. 3 is an isometric illustration of the instant invention in a vertical orientation.

FIG. 4 is an isometric illustration of the instant invention arranged for horizontal positioning.

FIG. 5 is an isometric illustration of a modification of the instant invention.

FIG. 6 is an orthographic cross-sectional illustration of the instant invention illustrating the operative actuation of an audible transmission device.

DESCRIPTION OF THE PREFERRED EMBODIMENT

With reference now to the drawings, and in particular to FIGS. 1 to 6 thereof, a new and improved novelty device embodying the principles and concepts of the present invention and generally designated by the reference numerals 10 and 10*a* will be described.

FIG. 1 illustrates a prior art fly swatter organization 1, wherein a fly swatter member 2 includes a target member mounted thereon, with an elongate handle 3 and scraper blade 4. FIG. 2 illustrates a further prior art insect impacting device 5 utilizing an attracting base and an overlying plate 6 selectively actuated upon impact to impact upon an insect positioned upon the base.

More specifically, the novelty device 10 of the instant invention essentially comprises a support block 11 including a planar top surface 12. An anvil plate 13 is fixedly mounted to and projects orthogonally and upwardly relative to the top wall 12. The anvil plate 13 is of a generally cylindrical configuration to complimentarily receive impact of a hammer head 16 of an associated hammer 18. The hammer 18 further includes a handle 17 orthogonally and medially mounted in a diametrically bisecting orientation relative to the hammer head 16. A first and second peg member 14 and 15 are mounted orthogonally relative to the top surface 12 underlying the anvil plate 13, with the anvil plate 13 bisecting a predetermined spacing between the first and second peg members. Further, the first and second peg members and the predetermined spacing is less than that defined by a predetermined axial length of the hammer head 16.

FIGS. 5 and 6 illustrate a modified novelty device 10*a*, wherein a modified support block 11*a* includes an elongate support block internal cavity 32, as illustrated in FIG. 6. A container 19 is mounted adjacent a modified anvil plate 13*a*, wherein the modified anvil plate 13*a* and the container 19 are positioned apart a further spacing, wherein the further spacing medially overlies the hammer head 16 to provide balancing of the organization when arranged in a vertical orientation, such as mounted upon a wall and the like. The container 19 includes an externally threaded upper end cooperative with a lid 20 and is internally threaded for mounting and closure of the container 19. The container 19 integrally mounted to the top wall 12 includes a predetermined quantity of simulated insect member 21 therewithin for positioning upon the anvil plate 13*a*. The anvil plate 13*a*, as illustrated, includes a central hollow hub 22, with a solid top annular flange 23 spaced from and parallel to a bottom annular flange 24. The bottom annular flange 24 includes a coaxially aligned cylindrical opening defining entrance into a hub cavity 25. The hub cavity 25 is defined by a predetermined diameter and includes a spring member 26 mounted therewithin overlying a microswitch 27. The microswitch 27 is cooperative with an underlying battery 28, wherein the battery 28 is defined by an external diameter substantially equal to the predetermined diameter to be received within the hub cavity upon depressing of the modified anvil plate 13 to a second depressed position in contiguous relationship with the top wall 12 from a first position spaced from the top wall 12, as illustrated in FIG. 6. Upon impacting of the top annular flange 23, the microswitch 27 is actuated effecting actuation of an associated audible device 29. The audible device 29 may be a tape player or conventional circuitry to effect an audible sound of a predetermined character consistent with a simulation of impacting of the simulated insect 21 by the hammer 18 such sounds may be from a class to amuse or entertain individuals such as the simulated sound of a dying creaure and the like. A perforated grid 30 is directed through a side wall of the modified support block 11, with an audible speaker member 31 positioned within the support block cavity 32 overlying the perforated grid 30 to direct an audible signal from the audible device 29.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A novelty device comprising, in combination, a support block, the support block including a top wall, with the top wall including an anvil plate integrally mounted to and orthogonally projecting outwardly from the top wall, and first and second peg members integrally and orthogonally mounted to the top wall underlying the anvil plate, with the first and second peg members spaced apart a predetermined spacing, and a hammer member mounted upon the first and second peg members, with the hammer member including a hammer head defined by an axial length greater than the predetermined spacing, with a handle integrally and orthogonally mounted medially of the hammer head, and further including a container, the container integrally and orthogonally mounted to the top wall adjacent the anvil plate, with the container including a lid removably mounted to an upper terminal end of the container, and the container including a cavity with a plurality of simulated insect members positioned therewithin to permit selective removal of an insect member of the plurality of insect members for positioning upon the anvil plate.

2. An apparatus as set forth in claim 1 wherein the anvil plate includes a central hollow cylindrical hub, the hub including a solid top annular flange spaced above the top wall, and a bottom annular flange spaced below the top wall within a support block cavity defined within the support block, and spring member means positioned within the hub to bias the top annular flange in a first spaced relationship relative to the top wall and permit deflection of the top annular plate to a second position in contiguous contact with the top wall.

3. An apparatus as set forth in claim 2 including a battery coaxially aligned with the hollow hub, the hollow hub defined by a predetermined diameter and the battery defined by a battery diameter, wherein the battery diameter is substantially equal to the predetermined diameter to permit reception of the battery within the hollow hub, and the battery coaxially aligned with the hollow hub.

4. An apparatus as set forth in claim 3 including a microswitch positioned between the battery and the spring member means, the battery operatively associated with an audible device, with the microswitch effecting electrical communication between the battery and the audible device to effect actuation of the audible device upon deflection of the top annular flange to the second position.

5. An apparatus as set forth in claim 4 wherein the support block includes a side wall, with a perforated speaker grid directed through the side wall into the support block cavity, with an audible speaker overlying the perforated speaker grid, and the audible speaker in operative association with the audible device.

* * * * *